United States Patent [19]

Goforth et al.

[11] Patent Number: 5,032,173

[45] Date of Patent: Jul. 16, 1991

[54] ALUMINUM FURNACE CHARGING SYSTEM AND PROCESS OF CHANGING

[76] Inventors: Billy D. Goforth; Charles L. Goforth, both of 1755 Armstrong, Fayetteville, Ark. 72701

[21] Appl. No.: 418,658

[22] Filed: Oct. 10, 1989

[51] Int. Cl.[5] ..... F27B 1/20; C22B 7/00

[52] U.S. Cl. ..... 75/330; 75/686; 75/687; 266/44; 266/78; 266/200; 266/901; 414/187

[58] Field of Search ..... 266/200, 901, 900, 78, 266/44; 414/187, 188, 198; 75/330, 686, 687

[56] References Cited

U.S. PATENT DOCUMENTS 4,581,063 4/1986 Oyabu et al. ..... 75/65 R

*Primary Examiner*—Melvyn J. Andrews

*Attorney, Agent, or Firm*—Boyd D. Cox

[57] ABSTRACT

An aluminum furnace charging system including a movable charger assembly, a hydraulically operated ram assembly, a hydraulically operated elevator and aluminum furnace having a hydraulically operated door whereby aluminum billets and/or scrap aluminum loaded onto the elevator is automatically and quickly charged to the furnace so that heat loss from the furnace and escape of molten aluminum from within the furnace is minimized.

28 Claims, 3 Drawing Sheets

ALUMINUM FURNACE CHARGING SYSTEM AND PROCESS OF CHANGING

FIELD OF THE INVENTION

This invention relates to an improved system for charging aluminum billets and other aluminum articles such as scrap aluminum to an aluminum furnace.

BACKGROUND OF THE INVENTION

Systems for loading aluminum to aluminum furnaces are well known. Typical aluminum furnace loading systems use a forklift to lift heavy, and sometimes unstable loads of aluminum billets or scrap aluminum to the height of the furnace door and then to deposit the aluminum into the interior of the furnace. This conventional method is undesirable, especially when the loads are unstable. Also, due to the potential of molten aluminum escape from the inside of the furnace when the forklift operator or others are in close proximity to the open furnace door, the conventional method of charging aluminum to the furnace is additionally undesirable. Furthermore, during conventional charging, the furnace door remains open a relatively long time and sufficient heat may be lost through the open door of the furnace to cause cold spots in the molten aluminum within the furnace.

OBJECTS OF THE INVENTION

It is an object of the present invention to provide an improved aluminum furnace charging system.

It is further object of the present invention to provide a remote controlled aluminum furnace charging system.

It is a further object of the present invention to provide an aluminum furnace charging system in which heat loss from and formation of cold spots within the furnace is minimized during charging operations.

It is a further object of the present invention to provide an aluminum furnace charging system which provides for safe lifting and loading of heavy materials into an aluminum furnace.

It is a further object of the present invention to provide a hydraulically operated ram type charger for loading an aluminum furnace.

DETAILED DESCRIPTION OF THE PREFERRED EMBODIMENT

Figure 1:
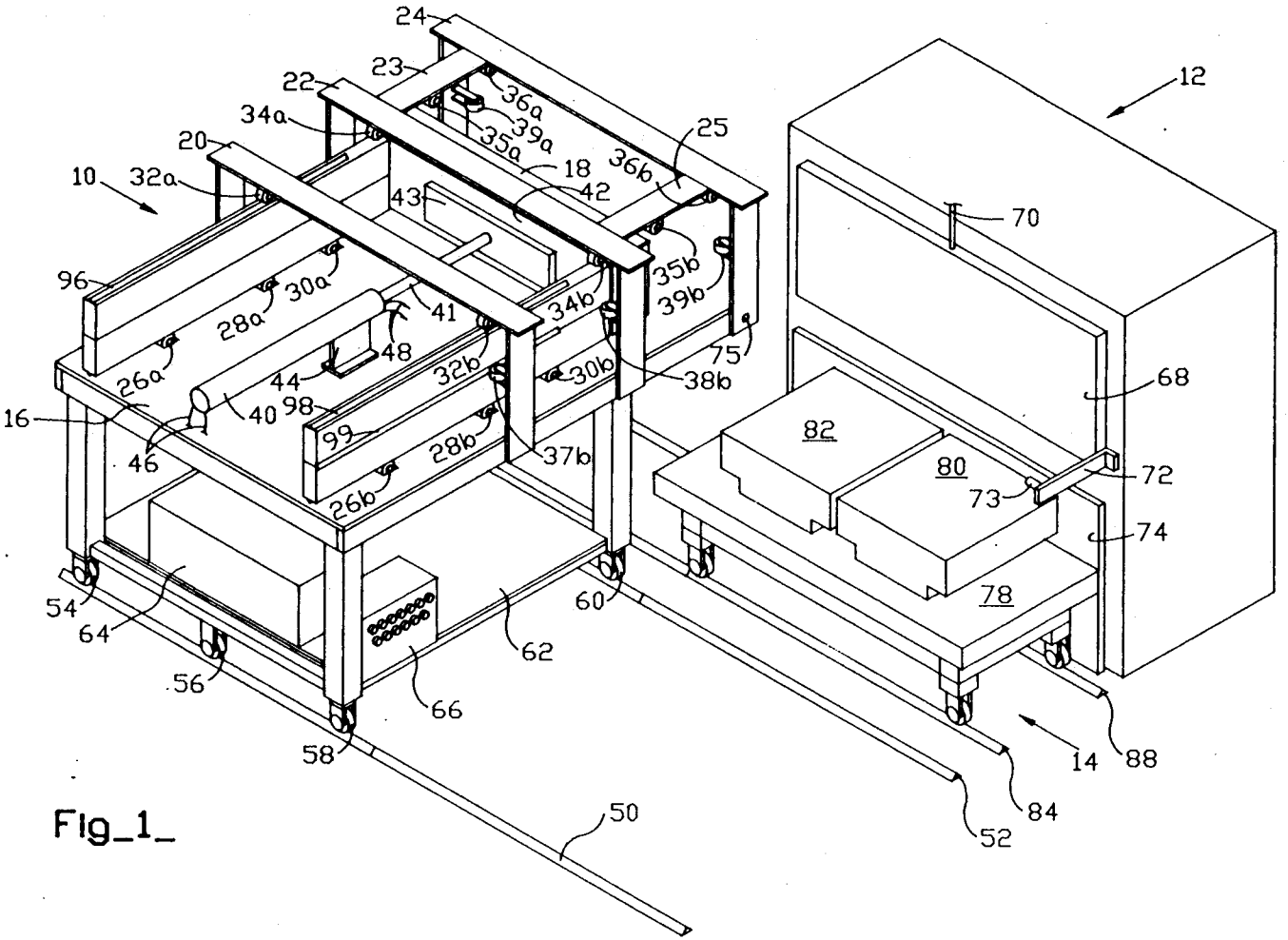
FIG. 1 is a perspective view of an aluminum furnace charging system of the present invention shown in precharging mode.
Figure 2:
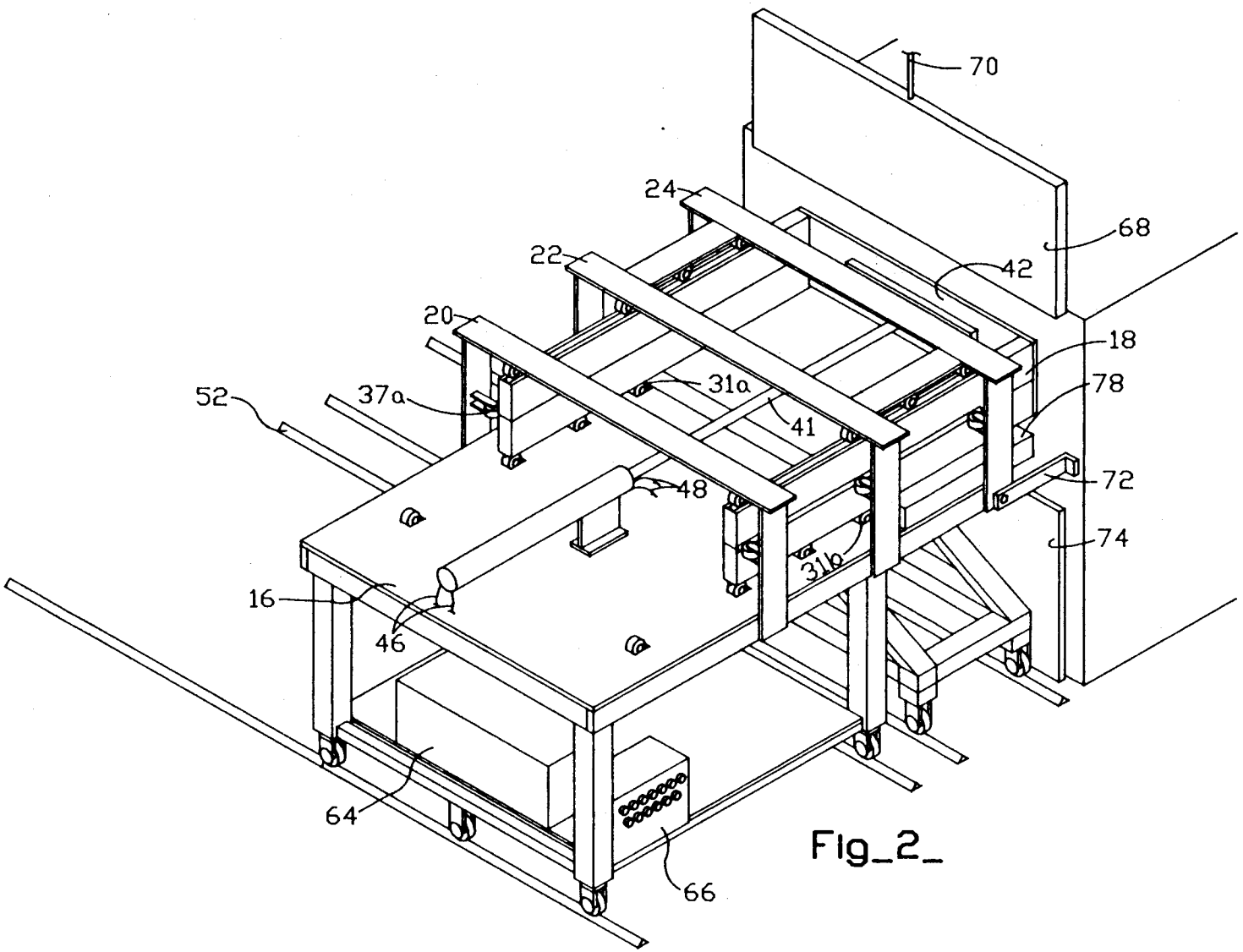
FIG. 2 is a perspective view of the FIG. 1 charging system shown in a charging mode.
Figure 3:
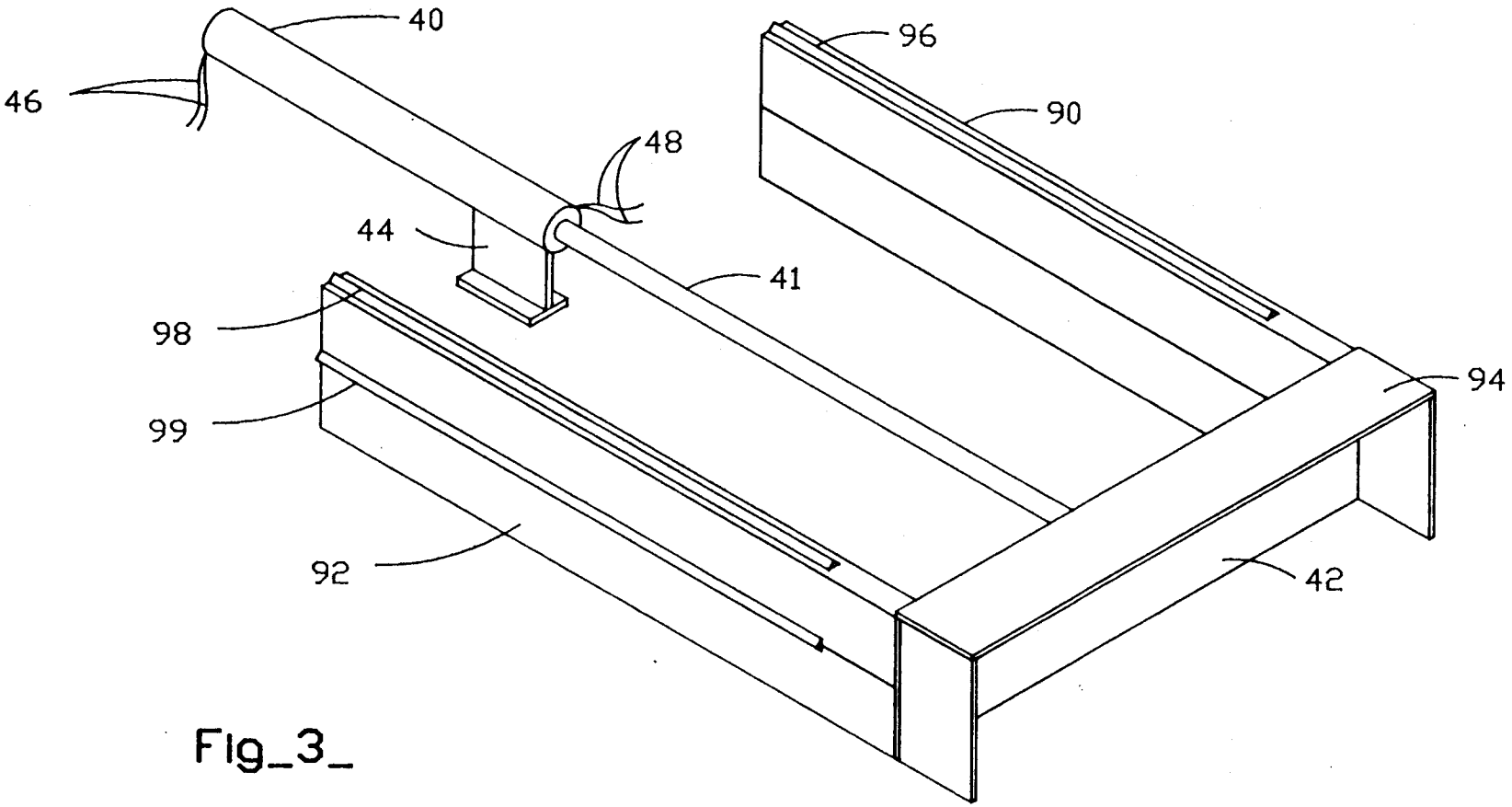
FIG. 3 is a perspective view showing details of the ram assembly of the FIG. 1 system.

With reference to FIGS. 1–3, the preferred embodiment of the present invention and its operation will be described.

Referring to FIGS. 1 and 2 the charger assembly 10, furnace 12 and elevator 14 are shown. Charger assembly 10 includes a flat surface, or table 16 upon which ram assembly 18 is positioned within framing members 20, 22, 23, 24 and 25. The ram assembly 18 is positioned on lower rollers 26*a* and *b*, 28*a* and *b*, 30*a* and *b*, 31*a* and *b* and under upper rollers 32*a* and *b*, 34*a* and *b*, 35*a* and *b*, 36*a* and *b*, and side rollers 37*a* and *b*, *38a* (not shown, but attached to framing member 22 in line with side rollers 37*a* and 39*a* and immediately opposite 38*b*) and *b* and 39*a* and *b* to provide for forward (toward furnace 12) and backward movement across the surface 16. The ram assembly 18 also includes hydraulic cylinder 40, piston 41 and front plate 42, the operation of which will be described hereinafter with reference to FIG. 2 and FIG. 3. Hydraulic cylinder 40 is fixed to the top of table 16 with a bracket 44 by conventional means, such as by welding or by bolting. Hydraulic cylinder 40 is shown with charge lines 46 and retraction lines 48 at opposite end, to permit circulation of hydraulic fluid for charging and retracting the piston 41 in a conventional manner. It should be noted that because of the heat emitted from furnace 12, a water soluble, nonflammable hydraulic fluid is preferably used to reduce the hazard of fire or explosion.

The charger assembly table 16 rests on four legs, not numbered, which are mounted on rollers to permit movement of the charger assembly 10 along tracks 50 and 52. Four of the wheel assemblies are shown at 54, 46, 58 and 60 respectively. The charger assembly also is provided with a lower surface or table 62 upon which a conventional power unit 64 and a control panel 66 are positioned. A conventional microprocessor controller, such as, for example, a programmable controller manufactured by Allen-Bradley, a Rockwell International Company, of Milwaukee, (Model No. 1745-LP151), not shown, is used to control operation of the charger assembly.

Aluminum furnace 12 is shown as a generally rectangular furnace having a furnace door 68 with cable 70 and pin bracket 72. Back stop 74 is positioned against the wall of the furnace. Door 68 covers the furnace entrance into which aluminum billets and/or scrap aluminum is charged.

Again referring to FIG. 1, elevator 14 is shown having a flat surface 78 upon which two aluminum billets 80 and 82 are positioned. Although elevator 14 is shown as having two aluminum billets, the number, weight and size of the billets may vary and other aluminum materials such as aluminum scrap may be placed on the elevator surface 78 in any conventional manner. It is preferred that the material to be charged be placed in abutment against the back stop 74.

Elevator 14 also includes a conventional elevating, or jacking system, shown in the retracted, or down position in FIG. 1 so that the surface 78 is close to the ground. Elevator 14 is also positioned on four legs, each of which has wheel assemblies like those of the charger assembly, to provide for movement of the elevator along tracks 84 and 88. However, in this preferred embodiment, elevator 14 is fixed in position with conventional means, such as by pinning or bolting, in front of furnace 12.

Referring to FIG. 2, the charger assembly of the present invention is shown with the ram assembly 18 in the charge position, that is, with the piston 41 and plate 42 in the fully extended position and furnace door 68 fully opened. Also referring to FIG. 2, the elevator 14 is shown in the extended, raised position.

Referring to FIG. 3 the ram assembly is shown having rectangular plate 42 to which is attached on its left and right sides and its top side rectangular members which extend forwardly and collectively define a hood 94. Fixed to the back side of plate 42 is piston 41 and at each distal edge of plate 42 long, rectangular, rearwardly extending beams 90 and 92 are attached by conventional means, such as be welding or bolting. Upper rails 96 and 98 are fixed to the top sides of beams 90 and 92, respectively, also by conventional means of attachment such as welding or bolting. In a like fashion, lower rails (not shown) are fixed to the bottom sides of beams 90 and 92. Also, side rails are similarly fixed lengthwise to the outer sides of beams 90 and 92. Side rail 99 is shown fixed to beam 92. The corresponding side rail fixed lengthwise to the outer side of beam 90 is not shown. The upper rollers 32*a*, 34*a*, 35*a* and 36*a* roll on upper rail 96. The upper rollers 32*b*, 34*b*, 35*b* and 36*b* roll on upper rail 98. The lower rollers 26*a*, 28*a*, 30*a*, 31*a* roll on the lower rail fixed to the bottom side of plate 90, while the lower rollers 26*b*, 28*b*, 30*l*, 31*a* roll on the lower rail fixed to the bottom side of plate 92. The side rollers 37*a*, 38*a* and 39*a* roll on the side rail fixed to the outer side of beam 90, and the side rollers 37*b*, 38*b* and 39*b* roll on side rail 99. All said rollers have a substantially V-shaped groove formed within the outer rolling surface thereof and all said rails are substantially V-shaped with the point of the V extending away from the side of the beam to which the rail is attached. Thus, when the rollers roll on the rails, the V-shaped rails fit within the V-shaped grooves of the rollers and non-linear movement of the ram assembly 18 is thereby restricted. The back of plate 42 is attached to the piston 41 by means of mounting plate 43 as shown in FIG. 1. Piston 41 is operatively connected in a conventional fashion to hydraulic cylinder 40 of the ram assembly 18. Charging lines 46 and retracting lines 48 are also shown as providing for hydraulic fluid entry to and exit from the cylinder 38. The cylinder 40 is rigidly attached to the table surface 16 through bracket 44.

With further reference to FIGS. 1–3, the sequence of operation for the charger of the present invention will be described.

First, a quantity, typically two billets, and typically weighing about twelve hundred (1200) pounds each and/or scrap aluminum is loaded onto the surface 78 of elevator 14. Typically the aluminum billets or scrap aluminum are placed onto the elevator 14 with a forklift and the aluminum billets or scrap aluminum are positioned to rest up against backstop 74, as shown in FIG. 1.

Upon manual initiation at control panel 66, or in accordance with a predetermined time sequence set up through control panel 66 and with the conventional microprocessor unit, not shown, the charger assembly 10 is moved laterally on tracks 50 and 52 to a pre-determined position directly in front of furnace 12 and opposite the loaded elevator 14. When the pre-determined position is reached, pins are automatically moved into position to secure the charger assembly 10 to the furnace 12. The pins are received by holes formed in the charger assembly. One of the pins is shown at 73 and one of the holes is shown at 75 for illustration purposes. In the preferred embodiment, two pins are used. Adjacent to pin 73 is a limit switch which is activated by the charger assembly which stops movement of the charger assembly along the tracks 50 and 52.

After the charging unit 10 is secured to the furnace in the proper position, the charging operation is started either manually or in accordance with a predetermined, timed program. Upon activation of the charging operation, the elevator 14 and furnace door 68 lift simultaneously. Movement of the furnace door 68 and elevator 14 are stopped through operation of appropriately placed limit switches, not shown.

In the preferred embodiment, the control circuitry is st up such that if the elevator 14 or door 68 do not reach their corresponding limit switches within a pre-determined time, the charging operation will automatically be stopped by the control system and an audible warning will sound. Also, the microprocessor control will cause the ram assembly 18 to automatically retract to the position shown in FIG. 1.

When the elevator 14 and the door 68 are at the proper, limited position, the ram assembly 18 is activated so that hydraulic fluid is charged to cylinder 40 through lines 46 to cause plate 42, hood 94 and side plates 90 and 92 to move forward, that is, toward the entrance of the furnace. In the preferred embodiment, activation of the ram assembly is automatically begun upon proper engagement of the limit switches on the elevator 14 and the door 68 when they each reach their pre-determined, extended and open, respectively, positions. Alternatively, the ram assembly may be activated through manual controls at control panel 66.

Upon activation of the ram assembly 18, the ram moves forward, that is, toward the open furnace until another limit switch, not shown, is activated. In the preferred embodiment, if the plate 42 does not reach the limit switch within a pre-determined time, the charging operation will stop, an audible warning will sound and the ram will automatically be retracted through operation of the microprocessor control system.

Immediately after activation of the limit switch upon the ram reaching a pre-determined, proper position, hydraulic fluid is fed to the cylinder 40 through retraction lines 48 and the ram retracts. Also, through programming of the microprocessor control system, the elevator will begin to descend at this time. When the ram plate 42 is fully retracted, furnace door 68 descends to its normal, closed position. Furnace door 68 is opened and shut through a conventional, hydraulic system which is controlled either automatically or manually through control panel 66. The charger assembly 10 then automatically moves away from the furnace along tracks 50 and 52 to its FIG. 1 position and to expose the top surface 78 of the elevator, for reloading, as appropriate.

This sequence is then repeated as many times as desired. The process sequence can be entirely automatic, or can be controlled entirely or partially, by an operator through appropriate controls at control panel 66, which is of conventional design. In a preferred sequence, the entire operation, except for loading the elevator 14, is automatic and is programmed to repeat at fifteen minute intervals.

An alternate preferred embodiment charger assembly is envisioned where the charger assembly frame is mounted directly to the furnace, such as by bolts, and is not moved along tracks during normal operation. In this alternative embodiment, only the elevator 14 is moved laterally along its tracks 84 and 88. After charging is complete the elevator 14 would be moved along its tracks and reloaded with aluminum billets, scrap aluminum, et cetera.

In either the preferred embodiment or the alternate preferred embodiment, the charger assembly unit and elevator 14 may be moved from the furnace for maintenance and cleaning. The framing 20, 22, 23, 24, 25 and roller 26*a* and *b*, 28*a* and *b*, 30*a* and *b*, 32*a* and *b*, 34*a* and *b*, 35*a* and *b* and 36*a* and *b*, 37*a* and *b*, 38*a* and *b*, and 39*a* and *b* associated with the ram assembly function to keep the ram assembly in place, to permit movement of the plate 42 toward and away from the furnace and to prevent tipping of the charger assembly unit during operation.

During operation of the conventional aluminum furnace charging systems, the forklift operator, and other workers in close proximity to the furnace door are often at risk to personal injury due to heat and possible molten aluminum being ejected out of the furnace. With the present invention, not only need there be no forklift operator close to the furnace door, but also the charger assembly, in particular the ram assembly plate 42, hood 94, and side plates 90 and 92 provide an effective shield to reflect heat back into and to retain molten aluminum within the furnace.

Also, when a conventional furnace, such as furnace 12, is being loaded by a conventional method using a forklift, the furnace door 68 must remain open much longer than with the present system. Thus, in conventional charging of an aluminum furnace sufficient heat is lost from the furnace when the door is opened that cold spots have been known to have been formed inside of the furnace. A conventional aluminum furnace, such as furnace 12, typically operates at temperatures of approximately 2300° F. When using conventional, forklift type charging technology, it is known that this operating temperature will typically drop approximately 600°-700° F. during the loading operation. However, when using the charging system of the present invention, it has been discovered that the temperature drop during the loading operation is limited to approximately 300° F. Reduction in this temperature loss during loading is due to the much faster charging times associated with the charger of the present invention and also due to the fact that the front plate 42 and hood 94 of the ram assembly reflect heat back into the furnace to thus additionally minimize the temperature drop associated with the loading process.

Although the preferred embodiment is directed to an aluminum furnace and loading of aluminum material into the furnace, the present invention may be applied to other types of furnaces. Also, manufacture of numerous alternate embodiments of the present invention is well within the ability of one of ordinary skill in the art, and the present invention is not limited to the above described preferred embodiments, but rather is limited by the appended claims and their equivalents.

We claim:

1. An aluminum furnace charging system for supplying metal to a furnace having an entrance and a door covering said entrance comprising:

an elevator having a horizontal platform, means for raising and lowering the platform, and means for operatively positioning the elevator with respect to said furnace entrance; and a movable charger assembly including means for positioning the assembly adjacent the elevator on a side thereof that is opposite that adjacent the furnace, means for pushing said metal off of the raised elevator platform for discharge into the furnace through its entrance when said furnace door is open, and means for controlling operation of said elevator, said door and said assembly.

2. The aluminum furnace charging system of claim 2 wherein the charger assembly further includes:

a ram assembly having a cylinder, a piston, and a plate having a front surface and a back surface, attached to one end of the piston and positioned on a platform of the charger assembly to push said objects off of the raised elevator platform upon extension of the piston from the cylinder.

3. The charge assembly of claim 2 wherein the ram assembly further includes a u-shaped hood attached to the plate and extending beyond the front surface of a plate a distance in the direction of movement of extension of the piston.

4. The system of claim 3 wherein the ram assembly further includes a pair of beams extending perpendicularly away from the back surface of the front plate, positioned, on a left and right side edge of the front plate and in the direction of retraction of the piston.

5. The aluminum furnace charging system of claim 2 further including a plurality of framing members positioned around and over said ram assembly.

6. The system of claim 2 further including a plurality of rollers operatively positioned to provide for movement of said ram assembly during operation of the piston and cylinder.

7. The charging system of claim 1 wherein the means for raising and lowering the platform of the elevator includes a hydraulically operated jacking system.

8. The charging system of claim 1 wherein the means for positioning the elevator directly opposite the furnace entrance includes a plurality of legs for supporting the elevator, and wheel assemblies resting on tracks which extend in a direction away from said furnace.

9. The charging system of claim 1 wherein the means for positioning the charger assembly includes a plurality of wheeled legs positioned on tracks extending away from said furnace.

10. An aluminum furnace charging system comprising:

an aluminum furnace having a front surface including a furnace opening, a furnace door closing said furnace opening over which said furnace door may be positioned, and a back stop located at a height below the height of the entrance;

a hydraulically operated elevator having a platform which may be raised or lowered and including means to move the elevator directly in front of the furnace and against said back stop;

a charger assembly having a generally horizontal platform located at a level substantially at the level of the furnace opening, a hydraulically operated ram assembly fixed on said platform and including a cylinder, a piston, and a plate oriented such that operation of the piston and cylinder causes alternating movement of the plate directly toward and directly away from the furnace opening; and a means for controlling the opening and shutting of the furnace door, raising and lowering of the elevator, extension and retraction of the hydraulically operated front plate and movement of the charge assembly away from a position adjacent the furnace door.

11. A process for charging a furnace comprising:

selecting a quantity of metal to be charged to the furnace;

placing the metal on a generally flat surface of an elevator in a first position adjacent to the furnace;

moving a charge apparatus laterally toward the side of the furnace against which the elevator is positioned until the charge is positioned opposite the furnace and adjacent the elevator, the first elevator position being between the charger and the furnace;

securing the charger to the furnace;

lifting the elevator to a second position which is at a height whereby the flat surface is adjacent an opening in the side of the furnace over which a furnace door is normally positioned and simultaneously lifting the door to an open position;

moving a ram driven plate in the charge apparatus against the metal from a first position to a second position so that the metal is charged through the opening and into the furnace;

stopping the ram driven plate when the ram has moved to the second position;

retracting the ram driven plate from the second position to the first position and simultaneously returning the elevator to its first position;

closing the furnace door;

moving the charger laterally away from the furnace; and repeating the process.

12. The process of claim 11 whereby all of the process steps are automatically controlled except for the steps of selecting the metal and placing the metal on the flat surface of the elevator.

13. The process of claim 11 wherein the metal is aluminum.

14. The process of claim 11 wherein the quantity of metal comprises aluminum billets and/or aluminum.

15. The process of claim 11 further including the step of retracting the ram driven plate if the elevator door has not reached a pre-determined position within a pre-determined time after it begins to lift.

16. The process of claim 11 wherein the ram driven plate is driven by a hydraulically operated ram.

17. The process of claim 16 further including a hood positioned on the ram driven plate.

18. The process for charging a furnace comprising:

selecting a quantity of metal to be charged to the furnace;

placing the metal on a generally flat surface of an elevator in a first position laterally away from the furnace;

moving the elevator laterally toward the furnace to a second position between a side of the furnace in which a door covered opening is positioned and a charger apparatus;

lifting the flat surface of the elevator to a height adjacent the opening and simultaneously lifting the door to an open position;

moving a ram driven plate in the charger apparatus from a first position to a second position against the metal so that the metal is charged through the opening and with the furnace;

stopping the ram driven plate when the ram has moved to the second position;

retracting the ram driven plate from the second position to the first position and simultaneously returning the elevator to its first position;

closing the furnace door;

moving the elevator laterally away from the furnace; and repeating the process.

19. The process of claim 18 whereby all of the process steps are automatically controlled except for the steps of selecting the metal and placing the metal on the flat surface of the elevator.

20. The process of claim 18 wherein the quantity of metal comprises aluminum billets and/or scrap aluminum.

21. The combination comprising:

a metal heating furnace having an opening in one side thereof and a movable door closing said opening;

a platform adjacent said opening for reception of charge metal to said furnace;

a charger assembly movable to and from a position adjacent said platform, said charger assembly comprising:

a mounting surface;

movable pusher means carried by said mounting means and operative to push said charge metal from said platform through said furnace opening when the door is removed therefrom;

means for moving said charger assembly with respect to said platform; and means for moving said pusher means between an extended and a retracted position for pushing said charge metal from said platform.

22. The combination according to claim 21 in which said pusher means comprises:

a hydraulically operated cylinder fixed to said mounting surface;

a piston movable in said cylinder between a retracted and an extended position; and a pusher plate carried by said piston at the forward end thereof and having a surface operative to engage said charge metal on said platform and to push it therefrom through said furnace opening as said piston moves from its retracted position to its extended position.

23. The combination according to claim 22 including plate means forming a hood attached to said pusher plate surface and extending forwardly thereof to reduce the release of heat from said furnace when said piston is in its extended position.

24. The combination according to claim 22 including means for guiding movement of said pusher plate including oppositely spaced beams attached to and extending rearwardly from said pusher plate, V-shaped guide rails extending longitudinally of and carried by said beams and rollers carried by the mounting surface having contoured rolling surfaces engaging said rails for guiding the movement of said pusher plate with respect to said mounting surface.

25. The combination according to claim 24 in which said beams are rectangularly formed and having guide rails on upper, lower and outer surfaces, and cooperating rollers carried by said charger assembly for guidingly engaging each of said rails.

26. The combination according to any one of claims 21 to 25 in which said opening is in an elevated position on said furnace, and including means for elevating said platform between a first, loading position and a second position adjacent said furnace opening.

27. The combination according to claim 26 including means for moving said platform with respect to said furnace.

28. The combination according to claim 27 including means for controlling the sequenced opening and closing of said furnace door, the movement of said charger assembly to and from its operative position with respect to said platform, the raising and lowering of said platform, and the extension and retraction of said pusher means.

* * * * *